US005611098A

United States Patent [19]

Skibik

[11] Patent Number: 5,611,098

[45] Date of Patent: Mar. 18, 1997

[54] COMBINATION STUDENTS ORGANIZER, SEAT CUSHION AND LAP DESK

[76] Inventor: John Skibik, 644 Amsterdam Ave. #1A, New York, N.Y. 10025

[21] Appl. No.: 383,067

[22] Filed: Feb. 3, 1995

[51] Int. Cl.[6] ..... A47C 20/02; A47B 23/00

[52] U.S. Cl. ..... 5/653; 5/420; 108/43

[58] Field of Search ..... 5/420, 462, 466, 5/653; 297/188.01, 219.1; 108/43

[56] References Cited

U.S. PATENT DOCUMENTS

| | | | |
|---|---|---|---|
| 2,044,717 | 3/1936 | McElmoyl . | |
| 2,740,466 | 9/1953 | Du Priest . | |
| 3,041,108 | 6/1962 | Cohn | 5/653 X |
| 3,143,748 | 8/1964 | Manning . | |
| 3,222,694 | 12/1965 | Schick | 5/653 |
| 3,232,662 | 2/1966 | Graves . | |
| 3,298,477 | 1/1967 | Martinez . | |
| 3,323,151 | 6/1967 | Lerman | 5/345 |
| 3,791,314 | 2/1974 | Berretta | 108/43 |
| 3,879,775 | 4/1975 | Iwata | 5/341 |
| 4,190,918 | 3/1980 | Harvell | 5/465 |
| 4,231,127 | 11/1980 | Bendell | 5/462 |
| 4,420,112 | 12/1983 | Cline | 229/72 |
| 4,685,570 | 8/1987 | Medow | 206/579 |
| 4,843,662 | 7/1989 | Handelmann | 5/481 |
| 4,854,637 | 8/1989 | McCree | 297/188 |
| 4,863,003 | 9/1989 | Carter | 190/8 |
| 4,925,241 | 5/1990 | Geraci | 297/229 |
| 5,265,292 | 11/1993 | Underell | 5/420 X |

*Primary Examiner*—Michael F. Trettel
*Attorney, Agent, or Firm*—Robert W. J. Usher

[57] ABSTRACT

A students portfolio type organizer is convertable to form a seat cushion, a lap desk or a rain hat and includes a hinged cover having inner and outer layers of waterproof sheet material defining between them first and second pockets joined by an elongate gusset hinge. Board members and pads of cushioning are retained in respective pockets providing a firm, outer writing supporting surface and a soft, inner cushioning surface. Inside compartments or pockets are provided for the receipt of writing materials. A strap member can be releasably attached at alternative locations as a carrying strap or as a chin strap retaining the cover in partly open position with the inner, cushioned layer engaging a top of a user's head.

7 Claims, 2 Drawing Sheets

COMBINATION STUDENTS ORGANIZER, SEAT CUSHION AND LAP DESK

FIELD OF THE INVENTION

The invention relates to a students combined portfolio type organizer, seat cushion and lap desk which, preferably, also provides a rain hat.

Reference is made to disclosure document 364813 dated Nov. 7, 1994.

BACKGROUND OF THE INVENTION

It is well recognized that most college students are required to sit for extended periods throughout the day in lectures, tutorials or seminars on uncushioned seating which can cause discomfort, sufficient even to distract the student, interfering with concentration and learning ability.

While carrying a separate cushion is generally considered so cumbersome as to be impractical, the prior art documents numerous prior attempts over many years to incorporate seat cushions with cases or bags for use in other fields or occupations.

For example, U.S. Pat. No. 4,843,662 issued to Handelman in 1989 teaches a portable, two person stadium seat case which can be unfolded to suitably position two soft pads or cushions which are carried in respective pockets and has a utility pouch on an outer or bottom cover portion of the case.

U.S. Pat. No. 4,190,914 issued to Harvell in 1980 teaches a hand carryable folding cushion assembly in which a pair of cushions are pivotally joined by a flexible panel and one of which has a pocket for carrying articles on an outside thereof.

U.S. Pat. No. 3,143,748 issued to Manning in 1961 teaches a combination container and cushion and U.S. Pat. No. 4,863,003 issued to Carter in 1989 teaches a combination seat cushion tote bag.

U.S. Pat. No. 4,854,637 issued to Mc Cree in 1989, teaches a seat cushion back pack for sporting events having various pockets for holding glasses, lotion, cameras and other miscellaneous items. U.S. Pat. No. 2,740.466 issued to Du Priest in 1956 teaches a portable stadium seat with cushioning.

However, none of the above-mentioned proposals make provision for, or suggest, means to accommodate writing materials, such as pens and papers, as an organized, portfolio, as would be required by a student attending a lecture, or to provide a firm surface for alternative use as a writing support or lap desk, for example when travelling.

U.S. Pat. No. 2,044,717 issued to McElmoyl in 1936 teaches another prior seat/bag conversion comprising a framed bag which opens to form a seat with a back support but without cushioning. U.S. Pat. No. 3,298,477 issued to Martinez teaches a convertible carrier, head rest and sun shade without cushioning. U.S. Pat. No. 3,232,662 to Graves in 1966 teaches a combination tray and seat apparatus.

SUMMARY OF THE INVENTION

One object of the invention is to obviate the above mentioned disadvantages by providing a students combined portfolio type organizer and seat cushion which may also function as a lap desk for writing support.

Another object of the invention is to provide a students combined portfolio type organizer and seat cushion which can optionally form a rain hat.

An additional object of the invention is to provide such students combination which is of relatively simple construction and which can be readily manufactured economically.

A further object of the invention is to provide such students combination which can be carried in alternative positions, for ease of use.

According to one object of the invention there is provided a combination students portfolio type organizer, seat cushion and lap desk comprising a folder having first and second cover members hingedly joined together along a spine, each cover member comprising a board member providing a writing support and an inner surface covered by a layer of cushioning, and means on the cushioning layer for retaining writing materials thereon, whereby the cover members can be pivoted between a closed, writing materials containing position in which the layers of cushioning are adjacent each other and an open, seat cushion forming position in which the cover members are unfolded into coplanar relation for engagement of the outer surface with a body support with the cushioning uppermost.

Thus, the folder functions as an organizer except when desired for use as a seat cushion when it is merely necessary to remove the writing materials therefrom and place in fully open position, outer, firm side down on a suitable support such as a hard seat or the ground itself. Thus, the combination is ideally suited for use in a campus environment.

Preferably, the board member has a water repellant outer surface and the combination Includes a chin strap securable between free edges of the cover members in a partly unfolded position for maintaining them extending apart obliquely with the cushioning engaging a user's head, providing a rain hat.

Thus, the user also has rudimentary rain protection which can quickly and easily be donned to cross exposed areas of the campus between lecture rooms, obviating need to carry an umbrella.

The invention also provides a combined students portfolio type organizer, seat cushion, lap desk and rain hat comprising:

a hinged cover comprising inner and outer layers of sheet material providing between them first and second pockets joined by an elongate gusset hinge, at least the outer layer of sheet material being water repellent;

first and second board members having inner faces covered by respective layers of substantially flat cushioning and retained in respective pockets to form respective panel portions on opposite sides of the hinge with a firm, writing supporting outer surface and cushioning inner surfaces;

writing material retaining means on respective inner layers; and, a strap member, whereby the cover can be pivoted between a closed, writing materials containing and seat desk forming position, an open, seat cushion forming position in which respective panels extend in substantially coplanar relation for engagement of the outer layer with a body support and an intermediate, rain hat forming position in which the panel portions extend obliquely and the strap is releasably securable thereto forming a chin strap with the inner, cushioned layer engaging a top of a user's head.

Advantageously, first and second sets of releasable securing means are provided on respective opposite ends of the strap and on the interior surface of the gusset hinge, adjacent opposite longitudinal ends thereof, respectively, and a third set of releasable securing means are attached to the cover adjacent respective free ends of the panel portions thereof and are engageable to secure the cover in closed position, so that, in a first operational mode, the securing means on the strap are engageable with the securing means on the gusset with the free ends of the strap received within the cover in a closed position and a medial portion of the strap extending outside the cover, along the gusset, forming a carrying strap, and in an alternative operational mode, the securing means on the strap are engageable with respective releasable securing means of the third set with the folder in partly open position, thereby to form the chin strap.

BRIEF DESCRIPTION OF THE DRAWINGS

A specific embodiment of a students combined organizer according to the invention will now be described by way of example only, with reference to accompanying drawings in which.

DESCRIPTION OF PARTICULAR EMBODIMENT

Figure 1:
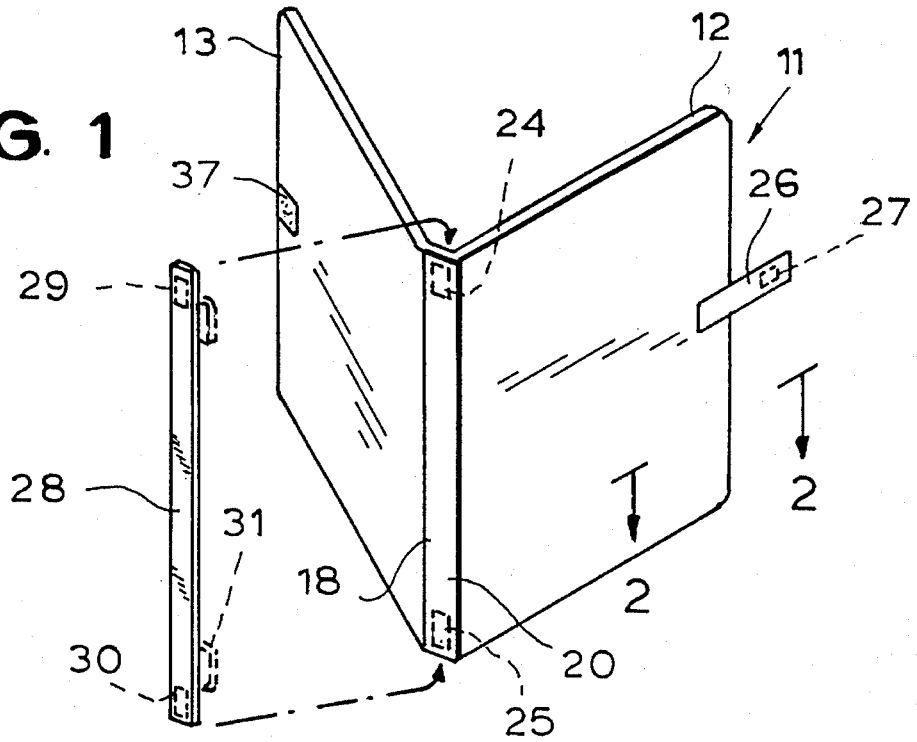
FIG. 1 is an perspective view of the outside of the combination organizer with a carrying strap thereof exploded therefrom.
Figure 2:
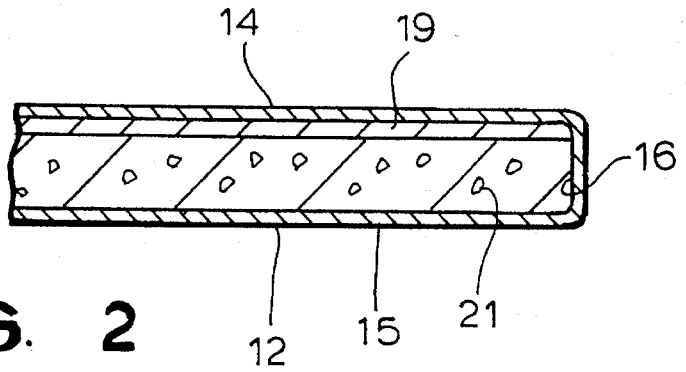
FIG. 2 is a cross-sectional view taken along lines 2—2 of FIG. 1.
Figure 3:
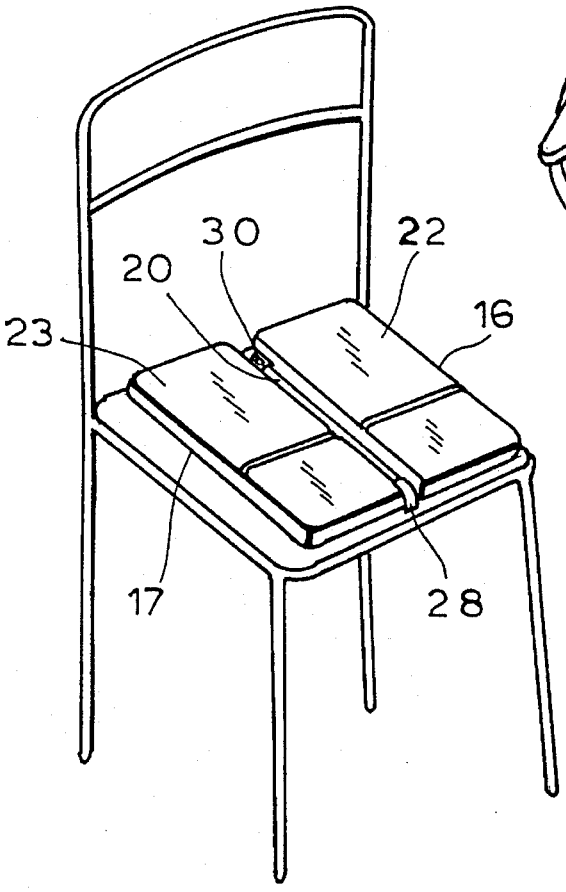
FIG. 3 is a perspective view showing the organizer on a chair in a fully open, seat cushion forming position.

Referring particularly to FIGS. 1–3, the combination students portfolio type organizer, seat cushion, lap desk and rain hat comprises a folder 11 having first and second cover members 12, 13, respectively, hingedly joined together along a spine 20 and comprising inner and outer layers 14, 15, respectively, of nylon fabric (eg CORDURA (a Trademark of DU PONT), sewn together to define first and second pockets 16, 17, respectively, (FIGS. 3 and 4) joined by an elongate flexible gusset 18 which forms the spine.

As shown particularly in FIG. 2, each cover member 12, 13 comprises a stiff, rectangular board member 19 of suitable plastic material and a rectangular pad 21 of cushioning, (suitably ethylene vinyl acetate closed cell foam), both being retained in a pocket 16, 17, so that the pad covers the inner surface of the board, in effect providing panel members pivotally joined together by the gusset hinge 18 and presenting a firm, outer writing supporting surface and a soft, inner cushioning surface.

As shown particularly in FIG. 3, a pair of pockets 22, 23 are provided on the inner layer for the orderly location of writing materials such as pens and papers. Two strips 24, 25 of pressure sensitive, hook and eye type releasable fastening material such as that sold under the trademark VELCRO synthetic materials which adhere when pressed together, are secured by stitching to the inner surface of the gusset at locations adjacent respective opposite longitudinal ends thereof. A closure strap 26 having a strip of similar releasable fastening material 27 at a free end is secured to one cover member adjacent a free end thereof for releasable attachment to a complementary strip 37 on the outside of other cover member for securing the cover members together in closed condition of the folder.

As shown in FIG. 1, a strap member 28 comprises a strip of similar nylon fabric material sewn folded to double thickness and has two strips 29, 30 of similar releasable pressure fastening material sewn adjacent respective opposite ends on one side of the strip and a third strip 31 of similar releasable pressure fastening material sewn to the opposite side, adjacent one end.

In assembling the cover, a single elongate length or run of fabric forming the outer or rear layer is laid flat and the closure strap, fastening material and writing materials receiving pockets are then sewn thereto. Opposite end portions are then turned back to overlie the outer layer, forming the inner layer and are sewn to the outer layer along both respective opposite side edges to define pockets having opposed open mouths at the adjacent edges of the respective returned end portions. The boards and pads are then inserted through respective mouths into respective pockets and a reinforcing strip of fabric having strips of fastening material sewn to an inner side thereof is overlaid on the inner layer in overlapping relation with adjacent edges thereof which define respective mouths and secured by parallel lines of sewing which pass through the reinforcing strip, the inner layer and the outer layer thereby closing the mouths and securing the inner and outer layers together to form the gusset hinge.

Figure 4:
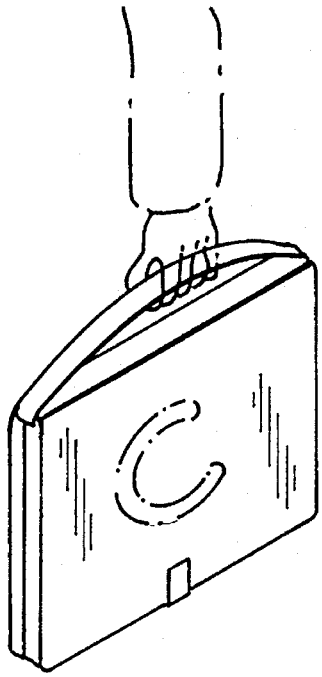
FIG. 4 is a schematic perspective view of the organizer being carried by the carrying strap.

As indicated in FIGS. 1 and 4, in a first operational mode as a carrying strap, the strap 28 is secured to the cover to lie along the outside of the spine by engagement of the fastening strips 29, 30 on each turned over end with those provided adjacent respective opposite ends of the gusset, enabling the organizer to be readily carried by the strap, as shown in FIG. 4.

Figure 6:
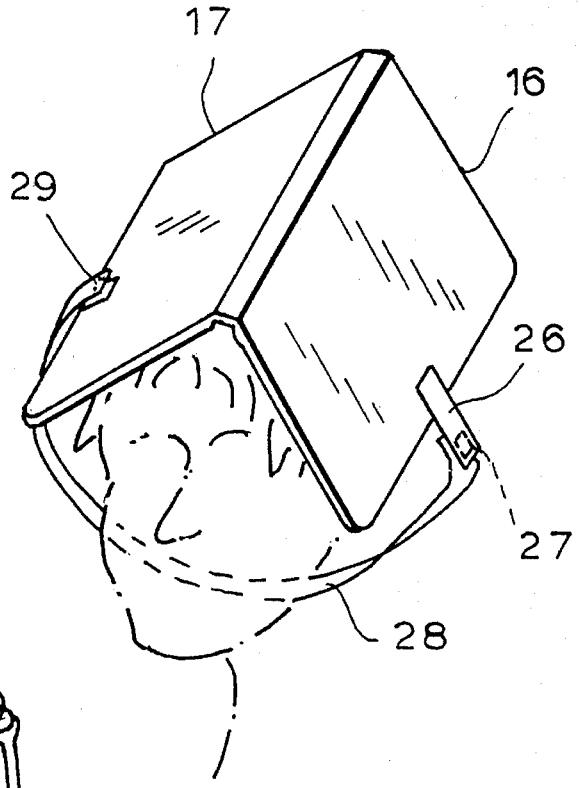
FIG. 6 is a perspective view of the organizer forming a rain hat with the strap providing a chin strap.

In an alternative operational mode, shown in FIG. 6, the folder is opened, the strap is removed from the gusset and secured by the single strip 31 of fastening material to the closure strip 27 and the fastening strip 31 on the other side secured to the other closure strip 37 so that the strap can form a chin strap to retain the partly opened folder on the head of a user, as a rain hat.

Figure 5:
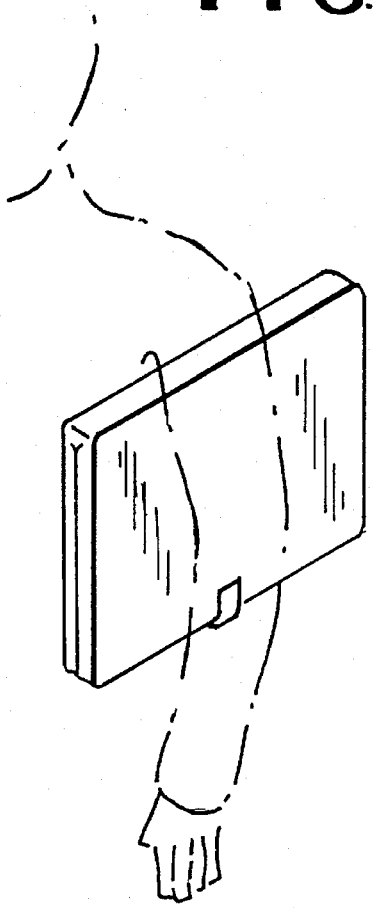
FIG. 5 is a schematic perspective view of the organizer being carried under an arm.

In view of the slimness of the combination, it may also be carried conveniently under the arm in a similar fashion to a conventional portfolio as shown in FIG. 5.

The folder converts from a portfolio type organizer to a seat cushion simply by opening the cover members to coplanar relation and laying flat on a seat, as shown in FIG. 3.

The concealed surface of the cover fabric is sprayed with a urethane while the exposed, finished surface is sprayed with a suitable lubricant a synthetic resin polymer, such as that sold under the trademark TEFLON.

The combination is particularly well suited to a campus environment as obviating need for students to carry additional undesirably cumbersome items such as cushions or umbrellas, while providing the functions of both, as well as a portfolio style writing materials organizer.

In a possible alternative structure, the cushioning is not formed separately from the board but sprayed onto an inner face thereof to provide an integral structure.

I claim:

1. A combination students portfolio type organizer, seat cushion, lap desk and rain hat comprising:

a hinged cover comprising inner and outer layers of sheet material providing between them first and second pockets joined by an elongate gusset hinge, at least the outer layer of sheet material being water repellent;

first and second rectangular board members having inner faces covered by respective layers of substantially flat cushioning and retained in respective pockets to form respective panel portions on opposite sides of the hinge with a firm, writing supporting outer surface and cushioning inner surfaces;

writing material retaining means on respective inner layers; and, a strap member, whereby the cover can be pivoted between a closed, writing materials containing and seat desk forming position, an open, seat cushion forming position in which respective panels extend in substantially coplanar relation for engagement of the outer layer with a body support and an intermediate, rain hat forming position in which the panel portions extend obliquely and the strap is releasably securable thereto forming a chin strap with the inner, cushioned layer engaging a top of a user's head.

2. A combination portfolio type students organizer, seat cushion, lap desk and rain hat according to claim 1 wherein first and second sets of releasable securing means are provided on respective opposite ends of the strap and on the interior surface of the gusset hinge, respectively, and a third set of releasable securing means are attached to the cover adjacent respective free ends of the panel portions thereof and are engageable to secure the cover in closed position, so that, in a first operational mode, the securing means on the strap are engageable with the securing means on the gusset with the free ends of the strap received within the cover in a closed position and a medial portion of the strap extending outside the cover, along the gusset, forming a carrying strap, and in an alternative operational mode, the securing means on the strap are engageable with respective releasable securing means of the third set with the folder in partly open position, thereby to form the chin strap.

3. A combination students portfolio type organizer, seat cushion and lap desk comprising a folder having first and second cover members hingedly joined together along a spine, each cover member comprising a board member having an uncushioned outer surface providing a firm writing support and an inner surface covered by a layer of cushioning, and means on the cushioning layer for retaining writing materials thereon, whereby the cover members can be pivoted between a closed, writing materials containing position in which the layers of cushioning are adjacent each other and an open, seat cushion forming position in which the cover members are unfolded into coplanar relation for engagement of the outer surface with a body support with the cushioning uppermost.

4. A combination students portfolio type organizer, seat cushion and lap desk according to claim 3 wherein the board member has a water repellant outer surface and further Including a chin strap securable between free edges of the cover members in a partly unfolded position for maintaining them extending apart obliquely with the cushioning engaging a user's head providing a rain hat.

5. A combination portfolio type students organizer, seat cushion and lap desk comprising:

a hinged cover comprising inner and outer layers of sheet material providing between them first and second pockets joined by an elongate gusset hinge, at least the outer layer of sheet material being water repellent;

first and second rectangular board members having inner faces covered by respective layers of substantially flat cushioning and retained in respective pockets to form respective panel portions on opposite sides of the hinge with a firm, writing supporting outer surface and cushioning inner surfaces;

writing material retaining means on respective inner layers; and, whereby the cover can be pivoted between a closed, writing materials containing and seat desk forming position, a fully open, seat cushion forming position in which respective panels extend in substantially coplanar relation for engagement of the outer layer with a body support.

6. A combination portfolio type students organizer, seat cushion and lap desk according to claim 5 including a strap member and means for releasably securing the strap member to the hinged cover in a first, carrying strap forming position and in a second, chin strap forming position retaining the hinged cover in a partly open position with the cushioning engaging a user's head, thereby providing a rain hat.

7. A combination portfolio type students organizer, seat cushion and lap desk according to claim 5 wherein the cushioning is provided by resiliently compressible pads formed separately from the board members.

* * * * *